US005240019A

United States Patent [19]

Rings

[11] Patent Number: 5,240,019

[45] Date of Patent: Aug. 31, 1993

[54] INDUSTRIAL DISHWASHER

[75] Inventor: Friedel Rings, Monheim, Fed. Rep. of Germany

[73] Assignee: Henkel Kommanditgesellschaft auf Aktien, Duesseldorf-Holthausen, Fed. Rep. of Germany

[21] Appl. No.: 842,414

[22] PCT Filed: Sep. 22, 1990

[86] PCT No.: PCT/EP90/01613

§ 371 Date: Mar. 26, 1992

§ 102(e) Date: Mar. 26, 1992

[87] PCT Pub. No.: WO91/04702

PCT Pub. Date: Apr. 18, 1991

[30] Foreign Application Priority Data

Sep. 30, 1989 [DE] Fed. Rep. of Germany ..... 3932806

[51] Int. Cl.[5] ..... A47L 15/16; A47L 15/44

[52] U.S. Cl. ..... 134/100.1; 134/199

[58] Field of Search ..... 134/68, 72, 99.2, 100.1, 134/103.2, 111, 131, 151, 153, 155, 186, 199, 200

[56] References Cited

U.S. PATENT DOCUMENTS

| | | | |
|---|---|---|---|
| 3,144,872 | 8/1964 | Kearney | 134/111 X |
| 3,457,929 | 7/1969 | Madden | 134/111 X |
| 4,190,481 | 2/1980 | Goffredo | 134/103.2 X |
| 4,211,517 | 7/1980 | Schmid | 134/103.2 X |

FOREIGN PATENT DOCUMENTS

| | | | |
|---|---|---|---|
| 252114 | 9/1948 | Switzerland | 134/186 |
| 1151958 | 5/1969 | United Kingdom | 134/111 |

*Primary Examiner*—Philip R. Coe

*Attorney, Agent, or Firm*—Ernest G. Szoke; Wayne C. Jaeschke; Kenneth Watov

[57] ABSTRACT

In an industrial dishwasher a cleaning solution which is highly concentrated relative to the rinsing water is recirculated in a washing region over items to later be rinsed, whereby the cleaning solution is directed into a collector trough, where the level of the solution is maintained automatically through use of a metering tank juxtaposed to the collector trough, whereby the metering tank collects rinse water, and a non-return flap valve located between the collector trough and metering tank provides for rinse water to flow from the metering tank into the collector trough only at such times when the level of the cleaning solution in the collector trough is lower than the level of the rinse water in the metering tank at upper-most regions thereof.

9 Claims, 1 Drawing Sheet

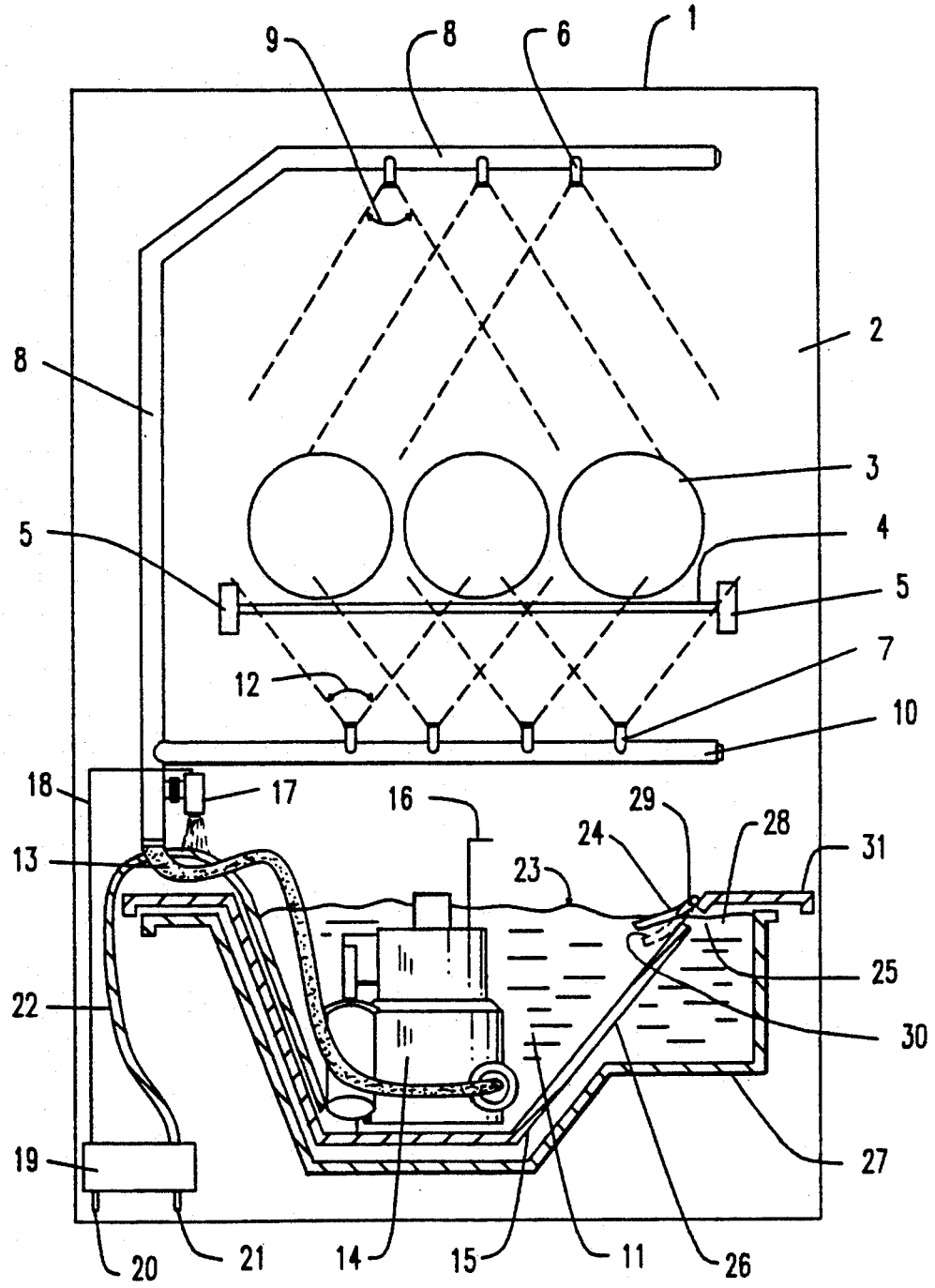
1
2
3
4
5
5
6
7
8
8
9
10
11
12
13
14
15
16
17
18
19
20
21
22
23
24
25
26
27
28
29
30
31

INDUSTRIAL DISHWASHER

BACKGROUND

1. Field of the Invention

This invention relates generally institutional dishwashing machines, and more specifically to such machines comprising a circuit for a detergent solution which is highly concentrated in relation to the wash liquor, and which is pump-circulated in a wash zone through the machine load.

2. Discussion of Related Art

In the context of the invention, the expression "machine load" or "dishes" is meant to encompass all the articles to be washed in dishwashing machines, more particularly plates, cups, cutlery and the like. Whereas normal wash liquor typically contains approximately 2 to 6 g detergent per liter of water, a "highly concentrated" detergent solution is one which contains approximately 30 to 80 g detergent per liter water. In institutional dishwashing machines (or IDWMS for short), the machine load is transported, for example on a belt, through various successive zones, more particularly a prerinse zone, a wash zone and a final-rinse zone.

In one known process for washing soiled dishes in a dishwashing machine comprising a wash zone, the prerinsed dishes are treated in the wash zone with a separately circulated, highly concentrated detergent solution. The detergent solution flowing down from the dishes flows into a collecting tank and from there to an external collecting tank or stock liquor container which is followed by a circulating pump supplying the circuit of the detergent solution. In the stock liquor container, the detergent solution is temporarily stored in the circuit. The concentration and amount of detergent solution in the circuit are also restored by controlling the solution in the stock liquor container. This requires sensors and corresponding feed pipes for fresh water and detergent concentrate.

EP-A-0 282 214 describes a process in which highly concentrated detergent solution is sprayed onto the dishes to be washed. This process is carried out in standard dishwashing machines in which a so-called spray arc is installed for spraying the highly concentrated detergent solution. The highly concentrated detergent solution is not collected or circulated separately in a circuit. Accordingly, there is no system separation between the highly concentrated detergent solution and the normally concentrated wash liquor although this would be desirable, for example for further minimizing the consumption of detergent.

SUMMARY OF THE INVENTION

An object of the present invention is to provide an institutional dishwashing machine in which the detergent solution is transported in highly concentrated form in the wash zone in a circuit comprising a pump/spray system, i.e. in a circulatory process parallel to the normal washing process, without any need for a controlled regulating system for making up losses of liquid from the circuit during spraying of the dishes, i.e. without any need for a collecting tank outside the machine.

In one embodiment of the present invention, a dishwashing machine includes a circuit for a highly concentrated detergent solution which leads through the machine load and through a collecting trough, a system for controlling the level in the collecting trough consisting of an opening which is provided with a one-way or non-return flap, which is permeable towards the collecting trough and which leads to a metering tank accommodating the wash liquor, and by a system for controlling the concentration of the detergent solution via control of a metering pump integrated into the circuit.

The one way or non-return flap valve acts like a sluice way between the metering tank accommodating the normally metered wash liquor and the collecting trough accommodating the highly concentrated detergent solution, whereby wash liquor will flow from the metering tank into the collecting trough as long as a predetermined minimum level is not exceeded in the collecting trough. If, by contrast, the liquid in the collecting trough rises above a predetermined level, the sluice-like opening is closed by the pressure of the detergent solution. A "sluice" is basically an automatic drainage gate in a sea dike which opens and closes tidally under the effect of ebb and flow; at highwater, the flood closes the valve whereas, at low water (ebb), the water dammed up on land opens the valve.

Accordingly, the connection according to one embodiment of the invention, the flap valve which is only permeable in one direction, allows normally metered wash liquor to flow into the collecting trough, but stops the highly concentrated detergent solution from flowing back into the metering tank. A certain leakage towards the metering tank is acceptable in the same way as the inflow of detergent solution spraying over from the machine load because the simultaneous detergent demand of the metering tank can be approximately covered in this way.

In the case of alkali detergents, the required concentration of normally metered wash liquor is of the order of 3 g alkali per liter water. The alkali solution is highly concentrated when it is approximately ten times more concentrated than the wash liquor, i.e. contains approximately 30 to 50 g alkali per liter water. In practice, the degree of concentration is variable within wide limits. Thus, even a concentration of 6 to 8 alkali per liter water is still regarded as normal.

Highly concentrated detergent solutions are crucial in cases where the machine load is sensitive to alkali. To obtain a good cleaning effect, the concentration should be high; to avoid damage to the machine load, the concentration should be low. In general, an optimal value determined by trial and error is selected and is maintained within certain tolerances by conductivity control. According to another aspect of the invention, therefore, a metering pump with a conductivity controller is associated with the circuit of the detergent solution. Accordingly, the circuit of the highly concentrated detergent solution should have not only its own circulating pump, but also its own metering unit with conductivity control separate from the concentration control of the metering tank.

According to the invention, as discussed above, a connection which, essentially, is only permeable towards the collecting trough is to be provided between the metering tank and the collecting trough. It would be logical, therefore, to arrange the collecting trough and the metering tank adjacent one another and to provide the opening in a common partition. However, this would require considerable extra space and corresponding redesigning of the machine. According to another aspect of the present invention, this space problem is solved by designing the collecting trough to fit into the metering tank. This built-in tank is intended to have its own circulating pump, its own spray register and its own metering unit with conductivity control.

The spray register of the metering tank holding the built-in tank may have to be partly stopped to ensure an adequate contact time of the highly concentrated detergent solution. Experience has shown that the reduction in the mechanical washing performance of the IDWM which may be caused by this measure is negligible against the carbohydrate-dissolving effect of the dishwashing process according to the invention.

A simplification is also achieved by the built-in solution mentioned above insofar as it is merely necessary for the connection permeable in only one direction to provide the opening with the non-return flap acting like a sluice in a partition between the metering tank and the collecting trough at a height substantially corresponding to the required level of the detergent solution. Accordingly, no electronic or electrical circuits are required for level control. Instead, level control takes place naturally, i.e. does not involve any enforced control.

If the collecting trough is accommodated as a built-in tank in the metering tank, it is preferred if, in accordance with another aspect of the invention, a collecting screen substantially covering the area beneath the machine load to be sprayed is associated with the built-in tank in order to ensure that as little of the sprayed, highly concentrated detergent solution as possible enters the metering tank and is prematurely diluted therein. However, screening does not have to be taken to the extent where no constituents of the detergent solution at all are able to enter the metering tank because the outflow of a small amount of the concentrate into the metering tank contributes towards maintaining the concentration therein.

BRIEF DESCRIPTION OF THE DRAWING

Various embodiments of the invention are described in detail in the following with reference to the accompanying drawing which is a vertical section, taken perpendicularly to the transport direction, through the wash zone of an industrial dishwashing machine in the drawing, like items are identified by the same reference designation.

DETAILED DESCRIPTION OF THE INVENTION

Inside an outer housing 1 (shown in chain lines) of an industrial dishwashing machine, the machine load 3, for example plates, are moved forwards through a wash zone 2 perpendicularly to the plane of the drawing on a conveyor belt 4 circulating on rollers 5. At the same time, the load, or plates 3 in this example, are sprayed with detergent solution from above from spray nozzles 6 and from below from spray nozzles 7. The upper spray nozzles 6 spray detergent solution 11 delivered through a pipe 8 onto the machine load 3, for example in approximately 60° spray cones 9 shown in chain lines. The lower spray nozzles 7 spray detergent solution 11 delivered through a pipe 10 onto the machine load 3, for example in approximately 110° spray cones 12. The pipes 8 and 10 are supplied via a hose 13 connected to the pipes at one end, and at its other end to an immersion pump 14. The pump 14 is contained in a built-in tank 15 accommodating the detergent solution 11. Power is supplied to pump 14 via an electrical lead 16. Associated with the supply of detergent to the pipes 8 and 10 is a conductivity throughflow measuring cell 17, which has an electrical connection 18 to a metering pump 19, for controlling the latter. An electrical connection 20 provides power to metering pump 19. The metering pump 19 is connected via a fiber-reinforced PVC hose 21 to a detergent container. A metering hose 22, for example of PVC, is connected at one end to an outlet port of metering pump 19, and has another end which terminates inside the bottom portion of built-in collecting tank 15.

A predetermined level 23 of detergent 11 is maintained in the built-in tank 15. The detergent level 23 lies substantially at the level of a sluice or non-return flap 24 which closes or leaves open an opening 25 in the wall 26 of the collecting tank 15, depending on the height of the detergent level 23. In the illustrated embodiment, the built-in tank 15 is accommodated in a conventional metering tank 27 of the dishwashing machine. The liquid level 28 in the metering tank 27 is adjusted in such a way that it can only open the non-return flap 24 when the detergent level 23 in the built-in tank 15 falls below a minimum level. To this end, it is sufficient if the non-return flap 24 is mounted to pivot about a substantially horizontal axis 29 and if the free end 30 of the flap 24 can bear against the inner surface of the wall 26 of the built-in tank 15 over a certain distance.

The liquid level 28 in the metering tank 27 is established (as usual) via an overflow wier to the preceding tank (cascade principle). The detergent concentration in the metering tank 27 can be maintained (again as usual) via a conductivity-type metering controller (not shown). For this purpose, more or less large collars acting as a collecting plate 31 may be provided at the edge of the built-in tank 15.

A major advantage of the detergent solution circuit stabilized in accordance with the invention is that the detergent solution is not supplied from a fresh water reservoir, which is generally cold, but instead is circulated and is therefore able to operate at a temperature of, for example, 50° to 60° C. which is adapted to the temperature of the already heated machine load. This temperature-controlled mode of operation improves cleaning performance and, in addition, avoids sudden cooling of the already heated machine load. Industrial dishwashing machines generally have several tanks, for example a tank associated with the prerinse zone which can contain freshwater or water of low detergent content, a metering tank containing substantially three grams detergent per liter water in the wash zone and, finally, a rinse tank in a rinse zone which contains substantially clean water. Lastly, there is the final-rinse zone in which freshwater heated to around 80° C. and containing a rinse aid is sprayed onto the machine load under the pressure of the flowing water. In many cases, several wash zones are provided between the prerinse zone and the final-rinse zone. The following rules apply to the choice of the correct location for the systems according to the invention:

a) Typically, the machine load 3 should be prerinsed before entering the wash zone 2 equipped in accordance with the invention.
b) To ensure that the large amounts of detergent 11 applied in accordance with the invention are reliably rinsed off, the tank 15 with the detergent solution circuit should be positioned in front of the final-rinse tank.

On the basis of these rules, the optimal location is preferably the penultimate tank of an industrial dishwashing machine. It is here that the tank 15 accommodating the concentrated detergent solution 11 should be installed in the metering tank 27. Under these conditions, the dishwashing machine and the pump/spray circuit operating in accordance with the invention are supplied as follows: after filling of the dishwashing machine, the metering tank 27 is normally metered via the normal conductivity-type metering controller. At the same time, the conductivity throughflow measuring cell 17 of the pump/spray circuit ensures that the built-in tank 15 is metered to a predetermined high level, for example 30 to 80 g alkali per liter water. In the further course of the dishwashing process, the metering tank 27 is supplied with detergent predominantly from liquid sprayed past the built-in tank 15 from the spray nozzles 6 and 7.

If the diluting effect predominates over the final-rinse water flowing in from the final-rinse zone, the associated conductivity controller occasionally responds to establish the required concentration, for example 3 grams per liter. If the amount of detergent from the solution 11 sprayed from the spray nozzles 6, 7 predominates, an equilibrium concentration is gradually established in the metering tank 27 although, even at high equilibrium concentrations (for example 10 grams per liter instead of the required concentration of, for example, 3 grams per liter). There is no danger of an unacceptable carryover of alkali, i.e. overloading of the plates 3 with detergent, because the washing zone 2 with the metering tank 27 is followed by a final-rinse tank with unmetered freshwater. Relatively large quantities of detergent still adhering to the load 3 are thus reliably rinsed off.

Although various embodiments of the invention have been shown described herein, they are not meant to be limiting. Those of skill in the art may recognize certain modifications to these embodiments, which modifications are meant to be covered by the spirit and scope of the appended claims.

What is claimed is:

1. An industrial dishwashing machine, comprising:

a circuit for a detergent solution which is highly concentrated in relation to an associated wash liquor;

a pump for circulating said detergent solution;

a wash zone in which a machine load is located;

a plurality of nozzles for receiving said detergent solution from said pump, and spraying said detergent solution into said wash zone through said machine load;

a collecting trough positioned for collecting said detergent solution passed through said machine load;

a system for controlling the level of said detergent solution in said collecting trough, said system including:

an opening through a side wall of said collecting trough;

a non-return flap with said opening, said non-return flap being permeable towards said collecting trough;

a metering rank having at least one portion containing said side wall of said collecting trough, whereby when the liquid level in said metering tank is higher than the level of said opening in said side wall, wash liquor flows from said metering tank, through said opening and by said non-return flap, into said collecting trough for at least partially controlling the concentration of the detergent solution in said collecting trough.

2. A dishwashing machine as claimed in claim 1, wherein said opening with said non-return flap functions like a sluice, and is provided in a partition between the metering tank and the collecting trough at substantially the required level of the detergent solution.

3. A dishwashing machine as claimed in claim 2, wherein said collecting trough is in the form of a tank built into said metering tank.

4. A dishwashing machine as claimed in claim 1, further including a metering pump with a conductivity controller associated with the circuit of said detergent solution.

5. A dishwashing machine as claimed in claim 4, wherein said collecting trough is in the form of a tank built into said metering tank.

6. A dishwashing machine as claimed in claim 1, wherein said collecting trough is in the form of a tank built into said metering tank.

7. A dishwashing machine as claimed in claim 6, further including a collecting screen substantially covering an area beneath the machine load to be sprayed and above the built-in tank.

8. A dishwashing machine as claimed in claim 1, further including metering pump means responsive to the concentration of said detergent solution for adding highly concentrated detergent thereto, whenever the concentration thereof falls below a predetermined level.

9. A dishwashing machine as claimed in claim 8, wherein said metering pump means includes a metering pump controlled by a conductivity controller monitoring the concentration of said detergent solution.

* * * * *